United States Patent [19]

Steinkuhle et al.

[11] Patent Number: 4,929,186

[45] Date of Patent: May 29, 1990

[54] CIRCUIT BOARD TERMINAL ASSEMBLY

[75] Inventors: Ferdinand Steinkuhle, Paderborn-Wewer; Klaus Strate, Detmold; Willi Dürkop, Reinheim; Ulrich Möller, Detmold, all of Fed. Rep. of Germany

[73] Assignee: C. A. Weidmüller GmbH & Co., Fed. Rep. of Germany

[21] Appl. No.: 327,698

[22] Filed: Mar. 23, 1989

[30] Foreign Application Priority Data

Mar. 26, 1988 [EP] European Pat. Off. ..... 88 104910.0

[51] Int. Cl.[5] ..... H01R 9/09

[52] U.S. Cl. ..... 439/78; 439/717

[58] Field of Search ..... 439/78, 81, 82, 83, 439/84, 712, 713, 715, 716, 717; 361/393, 394, 395, 396, 426; 200/292

[56] References Cited

U.S. PATENT DOCUMENTS

| | | | |
|---|---|---|---|
| 3,171,939 | 3/1965 | Ustin | 200/162 |
| 4,029,914 | 6/1977 | Schmidt et al. | 200/292 |
| 4,135,226 | 1/1979 | Kourimsky | 439/74 |
| 4,171,862 | 10/1979 | Krasser | 361/426 |
| 4,227,238 | 10/1980 | Saito | 439/78 |
| 4,603,930 | 8/1986 | Ito | 439/78 |
| 4,658,375 | 4/1987 | Onogi et al. | 361/426 |

FOREIGN PATENT DOCUMENTS

| | | |
|---|---|---|
| 2722736 | 11/1978 | Fed. Rep. of Germany . |
| 3227819 | 2/1984 | Fed. Rep. of Germany . |
| 8515405 | 9/1985 | Fed. Rep. of Germany . |

*Primary Examiner*—Neil Abrams

*Attorney, Agent, or Firm*—Laubscher, Presta & Laubscher

[57] ABSTRACT

A circuit board terminal assembly includes a circuit board having a plurality of conductor strips arranged thereon and a plurality of connector and functional terminals mounted on the circuit board. The connector terminals are adapted for connection with an electrical conductor and with the circuit board conductor strips while the functional terminals are adapted solely for electrical connection with the circuit conductor strips. Thus, a functional terminal is selectively electrically connected with the connector terminals and the other functional terminals via the conductor strips. Each terminal includes on its side walls elements for mechanically connecting adjacent terminals together.

4 Claims, 3 Drawing Sheets

CIRCUIT BOARD TERMINAL ASSEMBLY

BACKGROUND OF THE INVENTION

The present invention relates to a circuit board terminal assembly including a plurality of functional terminals or components, such as breaker terminals and fuse terminals, and a plurality of connector terminals adapted for connection with flexible-wire type electrical conductors, leads, and the like. The terminals are mounted on a circuit board having electrical conductor strips arranged thereon to form an electrical circuit having a desired configuration.

BRIEF DESCRIPTION OF THE PRIOR ART

In known circuit board terminal arrangements, both the conductor connection terminals and the functional terminals are provided with their own conductor connections. Thus the terminals could be arranged in any desired configuration as a terminal block assembly for connection with the circuit board. Such an arrangement, however, consumes a large amount of space on the circuit board and results in a circuit board assembly with extraneous components and increased costs.

The present invention was developed in order to overcome these and other drawbacks of the prior circuit board terminal arrangements by providing an arrangement which will accomodate all of the desired circuit combinations with ease of construction and assembly and considerable space savings.

SUMMARY OF THE INVENTION

Accordingly, it is a primary object of the present invention to provide an electrical terminal assembly including a generally planar circuit board having electrical conductor strips arranged thereon and a plurality of electrical terminals mounted on the circuit board. The terminals are of two types, namely connector terminals adapted for connection with a flexible-wire type electrical conductor and functional terminals which act as individual circuit components such as fuses, breakers and the like. Both types of terminals are selectively connected with the conductor strips on the circuit board via solder connections, for example. However, only the connector terminals include means for connection with at least one electrical conductor. Thus as distinguished from the prior devices, the functional terminals do not include any conductor connections. By providing a predetermined configuration of conductor strips on the circuit board and by selectively connecting the connector and functional terminals with the strips, a desired circuit configuration is defined. The connector and functional terminals are also provided with a housing structure enabling adjacent terminals to be mechanically connected together.

According to a further object of the invention, mechanical connection devices, such as dovetail connections, are provided on the side walls of the connector and functional terminals, with the connector terminals further including electrical connectors in the top wall thereof for connection with separate electrical conductors.

It is yet another object of the invention to provide at least two different types of functional terminals connected mechanically and electrically in series with a connector terminal.

According to a more specific object of the invention, a plurality of connector and functional terminals are mechanically connected in a predetermined configuration to define a terminal block for mounting on the circuit board.

BRIEF DESCRIPTION OF THE FIGURES

Other objects and advantages of the subject invention will become apparent from a study of the following specification when viewed in the light of the accompanying drawing, in which.

DETAILED DESCRIPTION

Figure 1A:
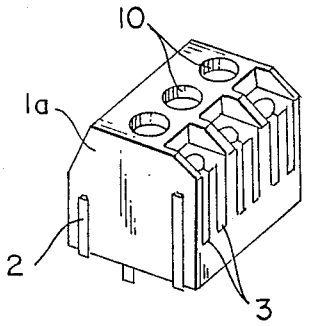
FIGS. 1*a* and 1*b* are perspective views of first and second embodiments of a connector terminal according to the invention.

Referring first to FIG. 1a, there is shown a first embodiment of a connector terminal 1a in the form of a three-pole bar segment. Of course, any number of poles may be provided. The terminal essentially comprises a housing having electrical connectors 10 in the top surface thereof for connection with one or more electrical conductors, i.e. flexible leads, wires and the like. On at least three side walls of the connector terminal 1*a* are provided mechanical connection elements for mechanically connecting the terminal with other terminals. More particularly, one or more dovetail bars 2 are integrally formed in the sidewall of the terminal housing. Corresponding dovetail grooves 3 are also provided in the housing.

Figure 1B:
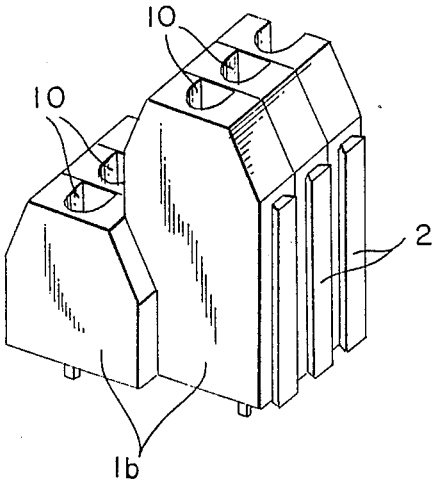

In the embodiment of FIG. 1*b*, an alternate connector terminal 1*b* is shown. This connector terminal is a dual trunk device with two sets of electrical connectors 10 at different heights. The terminal is formed of individual conductor terminal elements and although three elements are shown, any number may be provided. In lieu of separate conductor terminal elements, the double-trunk terminal may be formed as a bar segment as in FIG. 1*a*.

Figure 2A:
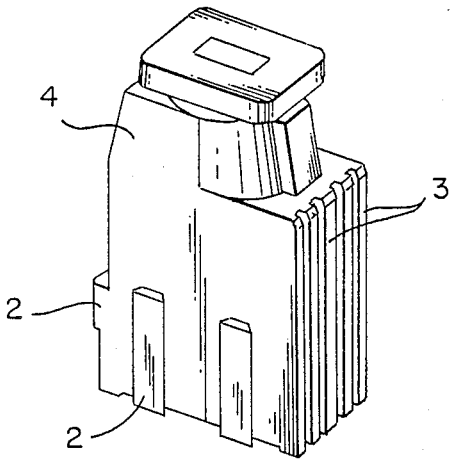
FIGS. 2*a* and 2*b* are perspective views of two types of functional terminals, namely a fuse terminal and a breaker terminal, respectively.
Figure 2B:
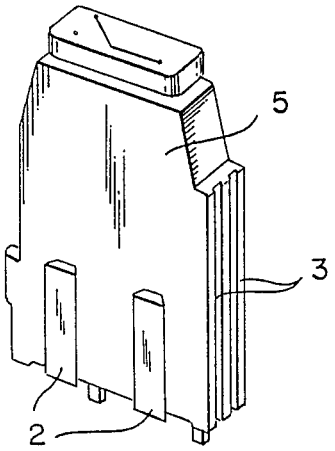

In FIGS. 2*a* and 2*b* are shown two different examples of functional terminals for use on circuit boards. The terminal of FIG. 2*a* is a fuse terminal 4 including a housing having mechanical connecting elements such as dovetail bars 2 and grooves 3 on all sides thereof. In FIG. 2*b* there is shown a breaker terminal 5 which is also provided with mechanical connecting elements on each side wall thereof. Although dovetail connectors are shown and described, any suitable connecting element may suffice.

Figure 3:
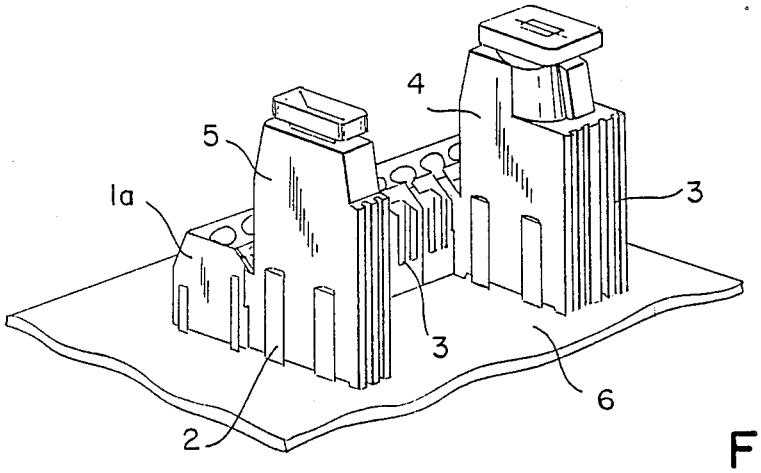
FIGS. 3 and 4 are perspective views of two different terminal block assemblies, respectively, showing the soldered connections between the terminals and the conductor strips on the circuit board.
Figure 4:
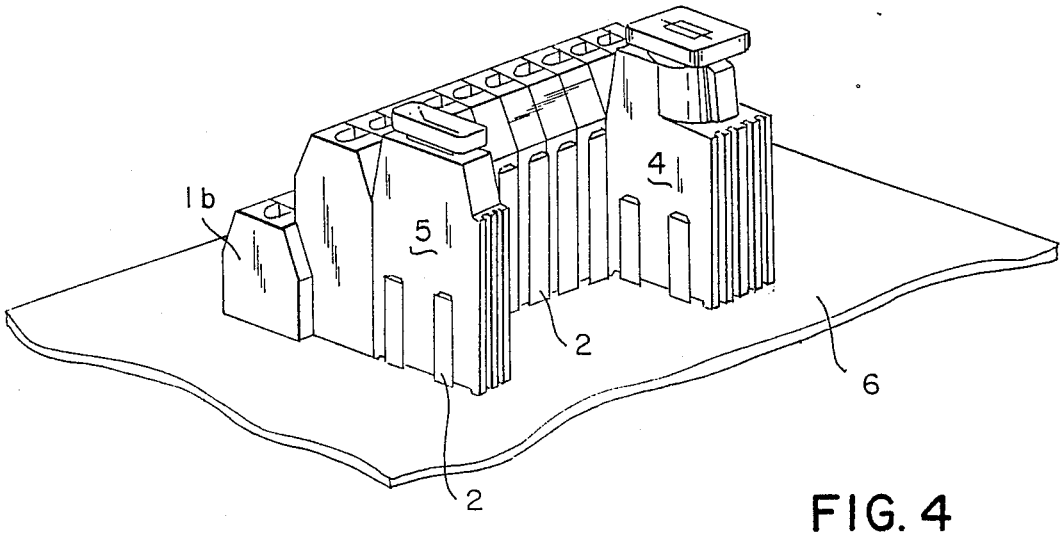

FIGS. 3 and 4 illustrate different circuit board terminal arrangements according to the invention. More particularly, in FIG. 3, a connector terminal 1*a* in the form of a bar with a predetermined number of poles is mechanically connected with a fuse functional terminal 4 and a breaker functional terminal 5. In FIG. 4, there is shown a connector terminal 1*b* in the shape of a dual-trunk terminal assembled from a plurality of connector elements and connected with a fuse terminal 4 and a breaker terminal 5. In both of the arrangements of FIGS. 3 and 4, the mechanically connected terminals are mounted on a generally planar circuit board 6 which has a plurality of conductor strips (shown in FIGS. 5*a* and 5*b*) arranged thereon. Although only a single connector terminal and single fuse and breaker terminals are shown in FIGS. 3 and 4, any number of functional terminals can be connected with the remaining connector and functional terminals in a predetermined configuration to define a terminal block assembly, each terminal being mechanically connected with an adjacent terminal. The terminal block assembly is mounted on a circuit board whose conductor strips are used for the electrical connection of the conductors connected with the connector terminals and the circuit elements of the functional terminals.

Figure 5A:
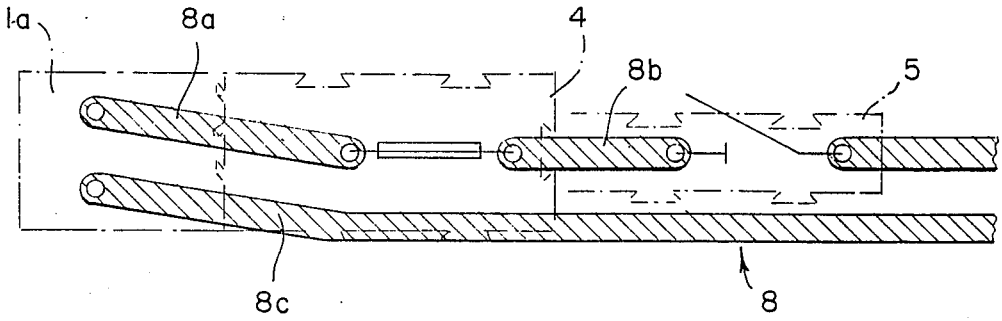
Figure 5B:
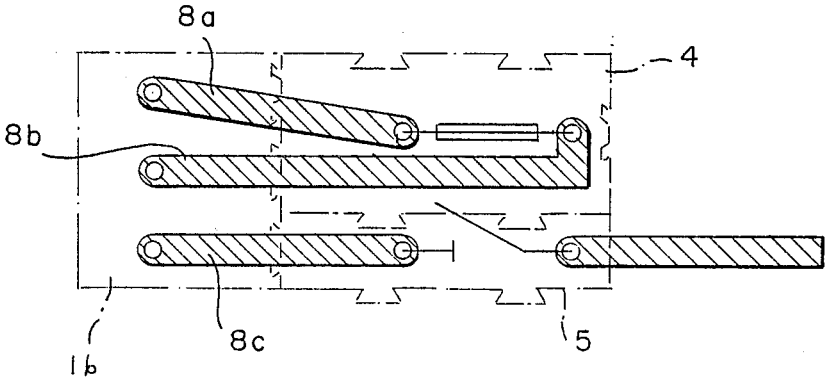

Referring now to FIGS. 5*a* and 5*b*, the mechanical and electrical interconnection of the connector and functional terminals will be described. In FIG. 5*a*, a two-pole connector terminal 1a is mechanically connected in series with a fuse terminal 4 which is mechanically connected in series with a breaker terminal 5. Electrically, the terminals are also connected in series, via conductor strips 8 of the circuit board (not shown) on which the terminals are mounted. That is, one pole of the connector terminal 1*a* is soldered at one end of the conductor strip 8*a* while a contact of the fuse terminal 4 is soldered with the other end of the conductor strip 8*a*. A second contact of the fuse terminal 4 is soldered to one end of the conductor strip 8*b* whose other end is soldered with a terminal of the breaker terminal 5. The second pole of the connector terminal 1*a* can be connected with a conductor strip 8*c* for other purposes.

In the embodiment of FIG. 5*b*, a special circuit arrangement of fuse and breaker terminals is shown. A three-pole connector terminal 1*b* is mechanically connected directly with both the fuse and breaker terminals 4, 5 in a block assembly. Electrically, two poles of the connector terminal 1*b* are connected with the two contacts on opposite sides of the fuse element of the fuse terminal 4 via conductor strips 8*a*, 8*b* while one pole of the connector terminal 1*b* is connected with one contact of the breaker terminal 5 via conductor strip 8*c*.

The individual types of functional and connector terminals which are needed for a circuit board terminal assembly can be made available individually by the manufacturer either for any desired circuit combination which the user may assemble or in a prefabricated terminal block assembly. In the latter case, the user need only mount the block on the circuit board and provide the necessary soldering welds for electrical interconnection.

It is apparent that other structural components may be mechanically connected with the circuit board terminal assembly of the present invention to construct various electrical devices incorporating the electrical circuit therein. When large numbers of terminals are used, a material cost saving is realized. This is due to the fact that the functional terminals can be manufactured at a greatly reduced cost since conductor connector elements can be omitted therefrom. Moreover, the number of electrical conductors required for the circuit is reduced, as are the space requirements. Finally, larger numbers of functional terminals increase the structural strength of the circuit board terminal assembly owing to the mechanical interconnection of the terminals and the increased number of solder connections to the circuit board conductor strips.

While in accordance with the provisions of the patent statue the preferred forms and embodiments of the invention have been illustrated and described, it will be apparent to those skilled in the art that various changes and modifications may be made without deviating from the inventive concepts set forth above.

What is claimed is:

1. An electrical terminal assembly, comprising (a) a generally planar circuit board having electrical conductor strips arranged thereon in a predetermined configuration;

(b) a plurality of electrical terminal means mounted on said circuit board, said terminal means including (1) at least one connector terminal adapted for electrical connection with at least one flexible-wire type electrical conductor and with said circuit board conductor strips; and (2) at least one functional adapted for electrical connection solely with said circuit board conductor strips, whereby said functional terminal is selectively electrically connected with said connector terminal via said circuit board conductor strips; and (c) each of said at least one connector and functional terminals including plural side walls containing interfitting means for mechanically connecting adjacent terminals together whereby said connector and functional terminals can be joined to one another and also joined in rows of like ones of said connector and functional terminals.

2. Apparatus as defined in claim 1, wherein said at least one connector terminal includes a top wall containing means for providing an electrical connection with at least one electrical conductor.

3. Apparatus as defined in claim 2 and further comprising two different functional terminals connected mechanically and electrically in series with said terminal.

4. Apparatus as defined in claim 1, and further comprising a plurality of connector and functional terminals mechanically connected in a predetermined configuration as a terminal block mounted on said circuit board.

* * * * *